US007958995B2

(12) United States Patent
Dedmon et al.

(10) Patent No.: US 7,958,995 B2
(45) Date of Patent: Jun. 14, 2011

(54) BAG-IN-BAG CONTAINER FOR BULK HANDLING OF FLUIDS

(76) Inventors: Franklin Dedmon, Milan, TN (US); Tony T. Hamaguchi, Milan, TN (US)

( * ) Notice: Subject to any disclaimer, the term of this patent is extended or adjusted under 35 U.S.C. 154(b) by 263 days.

(21) Appl. No.: 12/394,039

(22) Filed: Feb. 26, 2009

(65) Prior Publication Data

US 2010/0012550 A1 Jan. 21, 2010

Related U.S. Application Data

(60) Provisional application No. 61/081,582, filed on Jul. 17, 2008.

(51) Int. Cl.
*B65D 19/00* (2006.01)

(52) U.S. Cl. ..... 206/386; 220/495.06

(58) Field of Classification Search ..... 206/600, 206/386; 220/4.28, 495.06, 495.01, 4.33, 220/9.1, 9.4, 495.05, 4.29; 383/37; 108/55.1, 108/57.13

See application file for complete search history.

(56) References Cited

U.S. PATENT DOCUMENTS

| | | | | |
|---|---|---|---|---|
| 2,926,830 | A | 3/1960 | Kennedy et al. | |
| 3,194,471 | A | 7/1965 | Murphy | |
| RE28,846 | E | 6/1976 | Wait | |
| 4,157,609 | A | 6/1979 | Schutz | |
| 4,421,253 | A | 12/1983 | Croley | |
| 4,516,692 | A | 5/1985 | Croley | |
| 4,623,075 | A | 11/1986 | Riley | |
| 4,706,850 | A | 11/1987 | Remaks | |
| 4,793,519 | A | 12/1988 | Voorhies, Jr. | |
| 4,850,506 | A | 7/1989 | Heaps, Jr. et al. | |
| 4,903,859 | A | 2/1990 | Derby et al. | |
| 5,031,792 | A | 7/1991 | Russo, Sr. | |
| 5,209,364 | A * | 5/1993 | LaPoint, Jr. | 220/4.28 |
| 5,323,911 | A * | 6/1994 | Johnston et al. | 206/600 |
| 5,323,922 | A * | 6/1994 | Lapoint et al. | 220/4.28 |
| 5,356,029 | A | 10/1994 | Hogan | |
| 5,377,876 | A | 1/1995 | Smernoff | |
| 5,492,270 | A * | 2/1996 | Avery et al. | 229/117.24 |
| 5,735,429 | A | 4/1998 | Whitworth | |
| 5,799,812 | A | 9/1998 | Mansouri | |
| 5,813,562 | A * | 9/1998 | Perkins | 220/495.05 |
| 6,000,549 | A | 12/1999 | Perkins | |
| 6,015,057 | A * | 1/2000 | Stone et al. | 220/9.2 |
| 6,220,755 | B1 * | 4/2001 | Brown et al. | 383/119 |
| 6,224,260 | B1 | 5/2001 | Nickell et al. | |
| 6,516,965 | B1 * | 2/2003 | Perkins | 220/9.4 |
| 6,533,122 | B1 | 3/2003 | Plunkett | |
| 6,543,495 | B2 | 4/2003 | Hougland | |

(Continued)

*Primary Examiner* — Steven A. Reynolds
(74) *Attorney, Agent, or Firm* — Kenneth A. Roddy

(57) ABSTRACT

A palletized shipping container (10) for bulk handling of liquids and fluent materials has a collapsible inner bag (30) enclosed in a flexible outer liner/bag (11) having rigid stiffener panels (20) in pocketed sides. The inner bag has a bung at its top end for filling or discharge and a valve fitment (50) near the bottom for receiving a discharge valve. Tape tabs (34, 19) at upper ends of the inner bag and outer liner/bag attach to the top panel and/or stiffener panels to maintain the bags in an erect uncollapsed configuration. The stiffener panels prevent bulging of the inner bag and provide vertical support, but their lateral sides are spaced apart and form non-structural "floating corners" to maximize volume, minimize shock, vibration and abrasive forces on the inner bag, yet maintain impact and compression strength meeting international certification standards. The bung is disposed beneath the top panel after filling the bag to prevent access and provide a tamper resistant assembly.

16 Claims, 5 Drawing Sheets

U.S. PATENT DOCUMENTS 6,688,471 B2 * 2/2004 Stone et al. ..... 206/600
6,935,508 B2 8/2005 Stone et al.
7,244,064 B2 7/2007 Sullivan, Jr.
7,337,908 B2 3/2008 Dedmon
2002/0008517 A1 * 1/2002 Derby et al. ..... 324/318
2009/0250460 A1 * 10/2009 Chang ..... 220/9.4

* cited by examiner

BAG-IN-BAG CONTAINER FOR BULK HANDLING OF FLUIDS

CROSS REFERENCE TO RELATED APPLICATION

This application claims priority of U.S. Provisional Patent Application Ser. No. 61/081,582 filed Jul. 17, 2008.

FIELD OF THE INVENTION

This invention relates generally to palletized shipping containers for bulk handling of fluent materials, and more particularly to a palletized stackable shipping container for bulk handling of liquids and fluent materials having a collapsible inner bag enclosed in a generally rectangular flexible outer liner/bag having pocketed sides with rigid stiffener panels inside the pockets.

BACKGROUND ART

Containers and Intermediate Bulk Containers (IBC) are frequently used to ship, store, dispense, and handle liquids and other free flowing materials such as powders, pellets, etc. IBC's are also sometimes referred to as "totes". IBC's typically hold more than a 55-gallon drum but less than bulk (500-gallon) containers. The most popular sizes are 275 gallon (equal to five 55-gallon drums) and 330 gallon (equal to six 55-gallon drums). Some IBC's are of a "bag-in-a-box" construction wherein a primary container in the form of a flexible collapsible inner bag actually contains the material and a rigid box-like structure that forms a secondary container houses the flexible bag.

Containerized fluids experience severe handling forces such as vibrations, incline-impact, and dropping during shipment. In the "bag-in-a-box" type of shipping containers, the outer walls of the enclosed bag are subjected to continuous and abrasive movement of the bag against the walls of the rigid container. Such abrasion can result in bag breakage and leakage and resultant loss of contents and contamination of the surrounding area.

Some prior art "bag-in-a-box" bulk shipping containers leave the filling bung exposed and are thus subject to tampering.

Another problem with non-cubical bulk shipping containers is that they do not fit efficiently in a large freight container which results in wasted space.

When transporting palletized containers of the type described above from the manufacturer to the filling station, from the filling station to the customer, from the customer to the reconditioner and so on, the large-volume containers are loaded many times from the truck or a large container to conveyors and are being picked up and set down by fork lifts. The pallet configurations of most conventional palletized containers allow entry of the forks of the fork lift from only two of the four sides. Thus, access for lifting and handling is significantly limited and there is a likelihood of damage, spillage or leakage due to accidentally dropping a filled container.

Kennedy et al, U.S. Pat. No. 2,926,830 discloses a cardboard box having a liquid-tight plastic liner.

Murphy, U.S. Pat. No. 3,194,471 discloses a container having a flexible liner surrounded by a polygonal fiberboard tube having open ends and secured therein by adhesive which is received in an outer fiberboard container.

Wait, U.S. Pat. Re 28,846 discloses a collapsible pallet box having four sidewalls each in lapped relationship with the ends of the adjacent sidewalls when the box is erected. The sidewalls have aligned horizontal cleats, and the cleats have aligned channels carrying an endless strap running around the periphery of the box. The strap is slidable in the channel, and the cleats, are designed so that the strap is tight both when the box is erected and when it is collapsed.

Schultz, U.S. Pat. No. 4,157,609 discloses a method for forming a pallet-mounted container for liquids comprising a synthetic resin container in a metal shell that supports the container. The metal shell is a sheet metal jacket with a welded-on lid and bottom and is attached to a supporting wooden pallet.

Croley, U.S. Pat. No. 4,421,253 discloses a disposable bulk shipping container assembly for containing, shipping and dispensing liquids or semi-liquids. The container comprises a knocked-down fiberboard container body and end structure which can be set up on a pallet into a substantially rigid multi-sided polygonal drum-like container for receiving a flexible plastic bag that is to be filled with the substance to be dispensed. The bag is provided with a dispensing spout that is locked in dispensing position in one side of the fiberboard container to hold the bag in position in the container during filling, with its outer end exposed and which has a diaphragm type seal at its inner end. Croley, U.S. Pat. No. 4,516,692 discloses a similar disposable bulk shipping container assembly having a spacer and baffle between the upper end of the closed filled bag and the upper end structure to prevent upward surging with resulting distortion.

Riley, U.S. Pat. No. 4,623,075 discloses a bag-in-box type of container comprising a box enclosing a flexible bag filled with a pressurized liquid, such as a carbonated beverage, wherein the bag is located either inside a tube of rigid or inelastic material or inside a closed sleeve of elastic material. With the tube, transverse platforms with flanges directed towards respective ends of the box are arranged at each end of the tube to transmit pressure from the tube to the box. With a sleeve such platforms are not required, but a slotted platform is usually provided for location of the tap which projects from the bag.

Remaks, U.S. Pat. No. 4,706,850 discloses an improved push/turn tap and drain spout fitment for a multi-wall fiberboard container with a plastic retainer for retaining bulk flowable materials including a polygonal flange mounted within a similarly shaped opening in the fiberboard. A valve tube extendable through a spout assembly. The valve tube includes prongs for engaging a bung which is threadably connected to the spout assembly to seal an opening in the plastic retainer. The valve tube, though sealingly coupled to the spout assembly, can be moveably manipulated from the outside of the container to cause the bung to become disengaged from the spout assembly.

Voorhies, Jr., U.S. Pat. No. 4,793,519 discloses a composite disposable one-way container comprising an outer container of rectangular shape having upright continuous side walls and a substantially flat top wall formed of corrugated paper material. A unitary blow molded plastic inner tank having thin side walls is positioned upright inside the outer container so that the outer container maintains the inner tank in its upright position when the tank is filled with a liquid to be transported. A pallet member has a flat top supporting surface on which the outer container and the inner tank are supported.

Heaps, Jr. et al, U.S. Pat. No. 4,850,506 discloses a container for large quantities of fluent material having laminated walls made of multi-wall corrugated board. A flexible bag within the container has a first fitting that extends into an opening through a wall of the container near the bottom. A flap covers the opening and conceals the fitting being held in position by a severable strap. The container has bottom-forming flaps extending from the intermediate one of three layers forming the container to form a bottom for the container.

Derby et al, U.S. Pat. No. 4,903,859 discloses an improved flexible semi-bulk container utilizing rigid panels associated with the side walls of the flexible container to provide rigidity and enable the container to stand alone when filled with fluidized material such as fluidized solids, semi-solids, slurries and liquids.

Russo, Sr., U.S. Pat. No. 5,031,792, which is commonly owned with the present invention by way of assignment, and which is incorporated herein by reference, discloses a container for bulk handling of fluid materials that includes a rigid outer shell structure within which is positioned a flexible bag means adapted to receive, transport and discharge fluids. An intermediate liner is positioned between the shell and the flexible bag for prevention of abrasion of the bag surface. The internal bag has a fitment or bung at the top for either filling or discharge and a threaded discharge fitment at the bottom of a side wall designed for insertion of a discharge valve through the side wall. The container is shipped without the valve installed, and in order to dispense the contents, a discharge valve is inserted by seating it into the threaded area of the fitment. While being seated, a sharp nail-like probe on the valve pierces the bag to establish a fluid flow passageway so that dispensing may take place. The collapsible inner bag is supported on a flat bottom surface of the intermediate liner.

Lapoint, Jr. et al, U.S. Pat. No. 5,323,922 discloses a collapsible bag-like container that incorporates the features of a rigid, free-standing container, with the flexibility and collapsibility of a bulk bag. Stiffening members are placed into pockets, created by sewing together two sheets of woven polypropylene. The stiffening members may be removed and placed inside the bag for shipping, and then installed in the sewn pockets to create a collapsible container, suitable for containment, and shipment, of bulk materials of up to seventy (70) percent liquid composition. The container side walls have flaps that can be folded onto the top of the container, and tied together with flexible tie elements, such that the container has a desired transverse reinforcement.

Smernoff, U.S. Pat. No. 5,377,876 discloses a disposable bladder within in a box container having an interlocking spout wherein a locking flap in the outer container interlocks the spout and the outer container during dispensing of the contents.

Hogan, U.S. Pat. No. 5,356,029 discloses an improvement in a bin-type, bulk fluid container. The container comprises a rigid carton containing a plastic bag. The bag has an evacuation element on its side adjacent its bottom. The bag rests on a wedge shaped insert in the carton. The insert comprises a body molded in one piece from relatively dense, expanded plastic. The insert includes an upper panel supported by walls and partitions between the walls.

Whitworth, U.S. Pat. No. 5,735,429 discloses a corrugated fiberboard bulk shipping container for fluent materials having an outer box and an inner box inserted therein. The outer box is rectangular in cross section, and the inner box comprises two sleeves, each in the form of irregular octagons. During assembly of the container, flaps carried on the outermost of the two inner sleeves fold over the opening at one end of the inner sleeve and engage one another to fix the octagonal shape of the inner box. Extended corner portions on the flaps fit substantially into the outer box and stabilize the inner box within the outer box.

Mansouri, U.S. Pat. No. 5,799,812 discloses a reusable collapsible intermediate bulk shipping container adaptable to be used with a disposable inner fill bag, supplied in a corrugated cassette, upon a standard size pallet. The container has four interlocking wall frames with insertable wall panels forming inert interior wall surfaces, an engaging top member in addition to a halfwall member provides access for positioning a standard inner fill bag drain gland. The container is set up or collapsed and secured upon the pallet for return shipping or reuse.

Perkins, U.S. Pat. No. 6,000,549 discloses a bulk container that includes a flexible liner for holding fluent material, a plurality of substantially vertical rigid support walls spaced around the periphery of the liner, and a flexible skin interconnecting the walls and encircling the liner so as to laterally constrain and support the liner when fluent material is added. The container can include a bottom wall under the liner and connected to some of the support walls. A top platform can be removably secured over the liner so as to rest on top of the support walls. This provides the strength and rigidity to make the container system stackable. The support walls can be removably disposed in pockets or a sleeve in the flexible skin.

Nickell et al, U.S. Pat. No. 6,224,260 discloses a consolidation container that includes a back wall, side walls, and a front wall each comprising pockets which receive stiffening panels. The front wall has an openable center portion which provides access to the interior of the container. Support members are positioned in the corners of the container to facilitate stacking. A top normally overlies the wall to close the container and is fully openable to provide access to the interior thereof.

Plunkett, U.S. Pat. No. 6,533,122 discloses a foldable shipping container that provides users access to a liner fill port in confined areas and that can be used to transport liquids, powders, or solids. One embodiment of the shipping container has a generally rectangular base pivotally connected a first side wall and a second side wall, a first lid section pivotally connected to the first side wall, a second lid section pivotally connected to the second side wall, and a third lid section pivotally connected to the first lid section. The third lid section provides access to a centrally located liner fill port.

Hougland, U.S. Pat. No. 6,543,495 discloses a multiple access container having a holding portion adapted to hold fluent material and a transfer assembly having a flexible conduit and multiple access ports.

Stone et al, U.S. Pat. No. 6,935,508 discloses an octagon shaped stackable flexible intermediate bulk container having eight substantially identical side wall portions and eight stiffening panels. A bottom wall is connected to the bottom edges of the side wall portions and may be provided with a discharge port. Alternatively, a discharge port may be provided in one of the side wall portions. The bulk bag may be provided with a top wall which may be either openable or secured in place. A pallet and/or lift loops may be provided for transporting the bulk bag and the contents thereof. Belly bands extend around the periphery of the side wall comprising the side wall portions for reinforcing the side wall.

A multiple ply bag suitable for use in the present invention is a custom designed bag produced by CDF Corporation of Plymouth, Mass. similar to the type described in U.S. Pat. No. 7,244,064 assigned to the CDF Corporation, the complete disclosure of which is hereby incorporated by reference. It should be noted that, as described herein, the bag of the present invention has features that are not disclosed in the referenced patent.

Dedmon, U.S. Pat. No. 7,337,908, commonly owned with the present application, discloses a palletized shipping container for bulk handling of fluid materials having a rigid box-like outer shell within which is positioned a flexible bag and an intermediate corrugated liner sandwiched between the walls of the bag and shell. The bag has flap-like extensions at an upper end attached to the walls of the shell to maintain the bag in an erect uncollapsed configuration, a non-removable bung at its top end, and a non-removable discharge valve adjacent its bottom end. The bung is releasably retained at the top of the liner to maintain the bung in a proper position and prevent sagging of the bag. An inwardly and downwardly angled cushioned surface at the bottom of the shell supports the liner and bag, provides additional cushioning, facilitates emptying of the bag, and reduction of residual material.

SUMMARY OF THE INVENTION

The present invention is distinguished over the prior art in general, and these patents in particular by a palletized shipping container for bulk handling of liquids, fine powders, granular products and other matter with flow characteristics that has a generally cubical collapsible inner bag encased in a generally rectangular flexible outer liner/bag having pocketed sides with rigid stiffener panels inside the pockets, and a flat rectangular rigid top panel supported on the top ends of the stiffener panels. The top panel and stiffener panels protect the inner bag and its contents from blunt trauma and allow vertical stacking. The inner bag has a non-removable bung at its top end for either filling or discharge and a valve fitment near the bottom of one of its side walls for receiving a discharge valve. The inner bag and outer liner/bag have tape tabs at an upper end for attachment to the top panel and/or stiffener panels to maintain the bags in an erect uncollapsed configuration. The stiffener panels prevent bulging of the side walls of the inner bag and provide vertical support, but their lateral sides are spaced apart and not joined together so as to form non-structural "floating corners" defined by the corners of the outer liner/bag to maximize spatial volume, minimize shock, vibration and abrasive forces on the inner bag, yet maintain impact and compression strength to meet international certification standards. A bung at the top of the inner bag is temporarily supported in an opening in the top panel for filling and thereafter is released to allow the inner bag to slightly collapse such that the bung is disposed beneath the top panel and the opening is covered to prevent access and provide a tamper resistant assembly.

One of the features and advantages of the present invention is that it provides a new and improved shipping container for liquids and fluent materials.

It is another feature and advantage of this invention is that it provides a new and improved container for shipping liquids and fluent materials having an outer liner/bag that protects an inner collapsible bag from abrasive contact with surrounding surfaces.

Another feature and advantage of the present container is that it is suitable for use in shipping fluent materials because of the multiple layer collapsible inner bag fitted within the inner dimensions of an outer liner/bag having pocketed sides with removable rigid stiffener panels inside the pockets, and a flat rectangular rigid top panel supported on the top ends of the stiffener panels.

Another the feature and advantage of the present container is that it is suitable for use in shipping bulk liquids because of the outer liner/bag having pocketed sides with removable rigid stiffener panels inside the pockets, a flat rectangular rigid top panel supported on the top ends of the stiffener panels, and a multiple layer collapsible inner bag having a filling bung at its top end wherein the stiffener panels prevent bulging of the side walls of the inner bag and provide vertical support, but their lateral sides are spaced apart and not joined together so as to form non-structural "floating corners" defined by the corners of the outer liner/bag to maximize spatial volume, minimize shock, vibration and abrasive forces on the inner bag, yet maintain impact and compression strength to meet international certification standards.

Another feature and advantage of the present container is that the outer liner/bag having pocketed sides with removable rigid stiffener panels inside the pockets, and flat rectangular rigid top panel supported on the top ends of the stiffener panels, and a multiple layer collapsible inner bag having a filling bung at its top end which after filling and assembly is disposed entirely within the container provide a tamper resistant inner bag.

Another feature and advantage of the present container is that it has a multiple layer collapsible inner bag fitted within the inner dimensions of an outer liner/bag, the inner bag having a non-removable bung at its top end for filling and/or discharge, and also a discharge valve fitting secured adjacent its bottom end for receiving a discharge valve.

A still further feature and advantage of the present container is that it is to a palletized shipping container for shipping bulk liquids that has a collapsible inner bag fitted within an outer liner/bag having pocketed sides with removable rigid stiffener panels inside the pockets, and a flat rectangular rigid top panel supported on the top ends of the stiffener panels, which is secured to a pallet structure configured to allow entry of the forks of a fork lift from any of four sides to allow better access for lifting and handling and significantly reduce the likelihood of damage, spillage or leakage due to accidentally dropping a filled container.

Other features and advantages of the present container will become apparent from time to time throughout the specification and claims as hereinafter related.

DESCRIPTION OF THE PREFERRED EMBODIMENT

Figure 1:
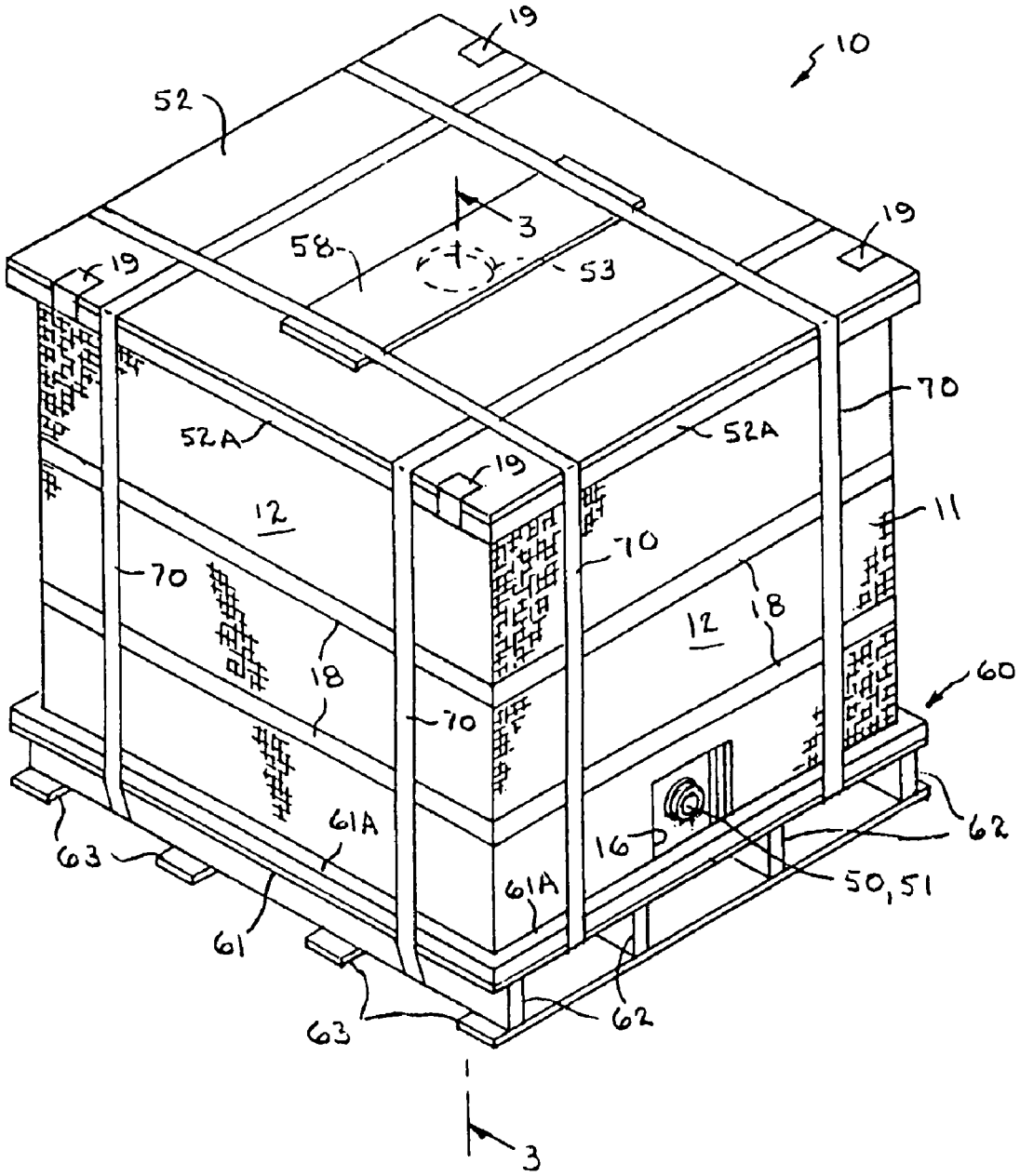
FIG. 1 is a perspective view of the shipping container in accordance with the present invention, shown in the assembled condition.
Figure 2:
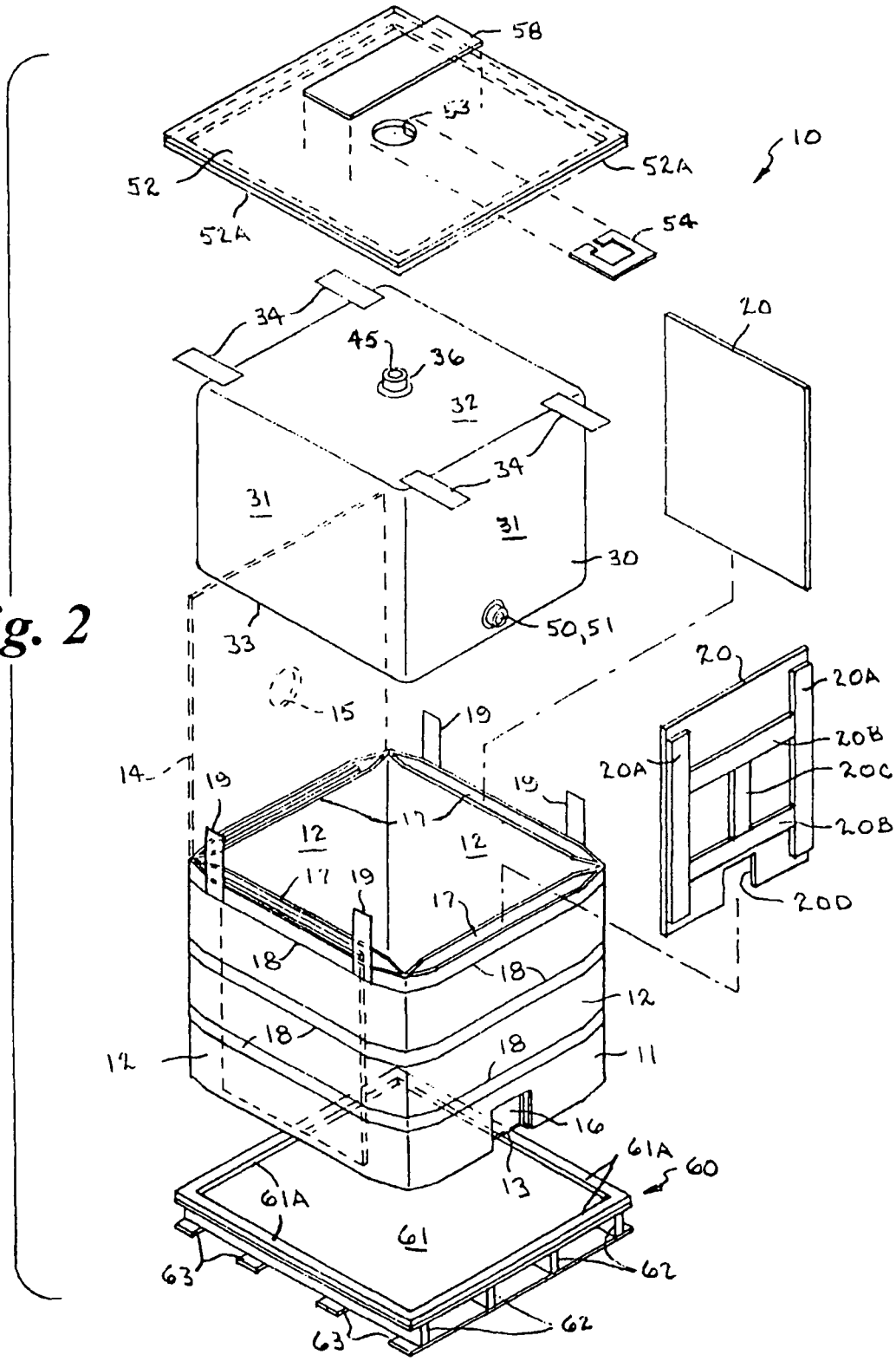
FIG. 2 is an exploded perspective view of the shipping container, showing the inner collapsible bag, outer liner/bag, stiffener panels, top panel and pallet members in an unassembled condition.
Figure 3:
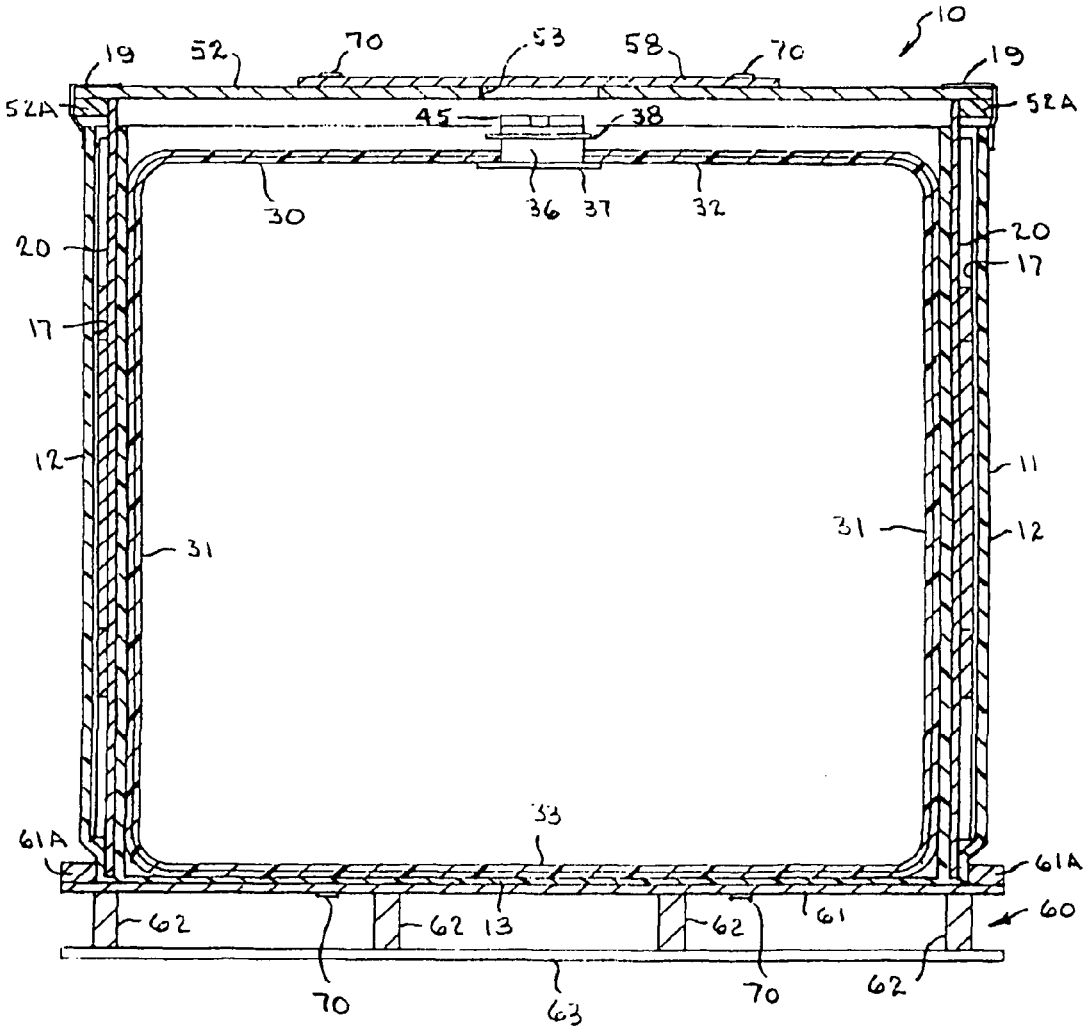
FIG. 3 is a vertical cross section of the assembled shipping container taken along line 3-3 of FIG. 1.

Referring to the drawings by numerals of reference, a preferred embodiment of a fully assembled shipping container 10 is shown in FIG. 1, and is shown exploded in FIG. 2 to reveal the principal elements, which include a generally rectangular flexible outer liner/bag 11 having pocketed sides 17, rigid stiffener panels 20 which are removably received inside the pockets of the outer liner/bag, a flexible inner bag 30 received in the outer liner/bag, a flat rectangular rigid top panel 52, and a pallet 60. The rigid top panel 52 is supported on the top ends of the rigid stiffener panels 20 in the pockets 17 of the outer liner/bag 11. The top panel 52 and stiffener panels 20 protect the inner bag and its contents from blunt trauma and allow vertical stacking.

The outer liner/bag 11 is formed of flexible double wall internal woven coated polyethylene or polypropylene (approximately 5 oz to 8 oz) and has four side walls 12, and a bottom wall 13. Optionally, the outer liner/bag 11 may also be provided with a flexible cover flap 14 which is secured at one end to the top end of one side wall and sized to cover the top end of the inner bag. The flexible cover flap 14 is also formed of flexible internal woven polyethylene or polypropylene and may be of lighter weight material (approximately 3 oz) and is provided with a circular hole 15. The polyethylene or polypropylene outer liner/bag 11 and cover flap 14 prevent abrasive contact of the inner bag 30 and its bung 36 (described hereinafter). The flexible cover flap 14 lays over the top wall of the inner bag 30 and the bung 36 at the top of the inner bag is received through the hole 15 and the rest of the flap is tucked or placed around the inner bag. The cover flap 15 eliminates the need for a stiff corrugated liner, however, it should be understood that the outer liner/bag 11 may also be provided without the flexible cover flap 14. An opening 16 may be provided at the bottom end of at least one of the side walls 12 of the outer liner/bag 11 to allow a discharge valve to be secured to a valve fitment on the lower end of the inner bag (described hereinafter). Although in a preferred embodiment the outer liner/bag 11 and cover flap 14 are described as being formed of polyethylene or polypropylene, it should be understood that they may be formed of other suitable liquid impervious materials.

The double walls of the outer liner/bag 11 are stitched or otherwise secured together at the bottom and at the corners such that the side walls 12 form open top end pockets 17, the top ends of which may be hemmed to facilitate insertion of the stiffener panels 20 into the pockets. The four outer walls 12 of the double wall liner/bag 11 are surrounded by three vertically spaced strips of reinforcement webbing 18. At least two opposed walls 12 of the double wall liner/bag 11 are also provided with tape tabs 19 adjacent to the corners which are formed of strips of webbing having peel and stick adhesive tape at their outer ends for attachment to the top panel and/or stiffener panels to maintain the liner/bag in an erected uncollapsed configuration during shipping and storage.

Each of the stiffener panels 20 is constructed of a rectangular sheet of plywood with wooden reinforcing boards secured to an outer facing surface. In the illustrated example, a pair of reinforcing boards 20A are secured vertically to the plywood sheet along laterally opposed sides, a second pair 20B is secured horizontally in vertically spaced relation between the vertical members, and a third vertical reinforcing board 20C is secured centrally between the horizontally spaced and laterally spaced reinforcing boards 20A and 20B. The laterally spaced vertical reinforcing boards 20A terminate a short distance inward from the top and bottom ends of the plywood panel.

The width of the stiffener panels 20 is less than the width of the pockets 17 of the outer liner/bag 11 such that, when installed in the pockets, their lateral sides are spaced a distance apart and are not joined together so as to form non-structural "floating corners" defined only by the corners of the outer liner/bag 11 to maximize spatial volume, minimize shock, vibration and abrasive forces on the inner bag 30, yet maintain impact and compression strength to meet international certification standards. The stiffener panels 20 are sufficiently rigid and strong to prevent bulging of the side walls of the inner bag 30 and provide sufficient vertical support to allow stacking of the containers.

At least one of the stiffener panels 20 is provided with a central generally rectangular opening 20D at its bottom end generally aligned with the opening 19 at the bottom end of the side wall of the outer liner/bag 11 to allow a discharge valve to be secured to a valve fitting secured to the lower end of the inner bag 30.

Figure 4:
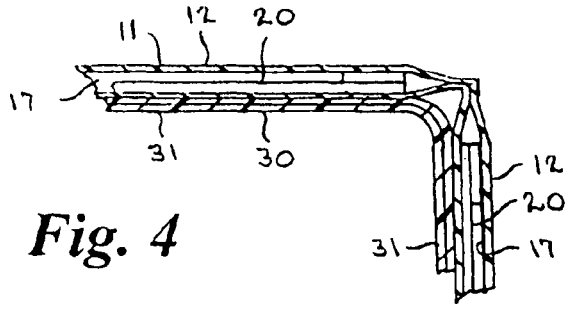
FIG. 4 is a cross sectional view of a corner portion of the assembled shipping container, showing the spaced apart adjacent sides of the stiffener panels and "floating corner" defined by the corner of the outer liner/bag.

The reinforced multiple ply collapsible inner bag 30 that is received in the outer liner/bag 11 is formed of multiple plies of polyethylene or other suitable liquid impervious materials and has four side walls 31, a top wall 32, and a bottom wall 33, which meet at their respective corners as shown in FIG. 1 to form a cube-shaped bag which, when filled, fits closely within the internal dimensions of the outer liner/bag 11. The inner bag 30 is constructed such that the ends of the walls are heat sealed at the appropriate corners to form a unitary, airtight collapsible bag. Cube-shaped bags are typically easier to fill, have fewer folds and retain less residual product after dispensing than pillow shaped bags, however, a pillow-shaped bag may be used in some applications. The inner bag 30 has four laterally spaced generally rectangular tape tabs 34, each having one end secured at the top wall 32 or the top portion of two opposed side walls 31 to form extensions of the bag and an outer end extending outward from the bag. As shown in FIG. 4, the tape tabs 34 are of sufficient length to extend over the top of the stiffener panels 20 in the pockets 17 of the outer liner/bag 11 and their outer ends are provided with peel and stick adhesive tape for attachment to the top panel 52 and/or stiffener panels 20 to maintain the inner liner/bag in an erect uncollapsed configuration during shipping and storage. Alternatively, the outer ends of the tape tabs 34 may be secured by stapling, nailing, or other conventional means.

Figure 5:
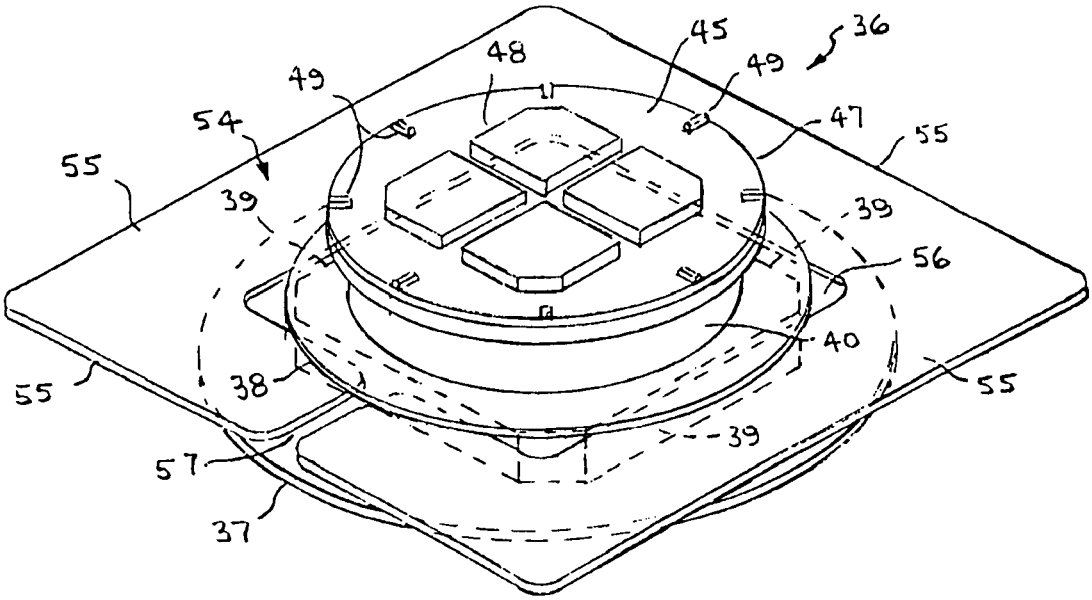
FIG. 5 is a perspective view of a bung and retainer flange for supporting the top of the bag.
Figure 6:
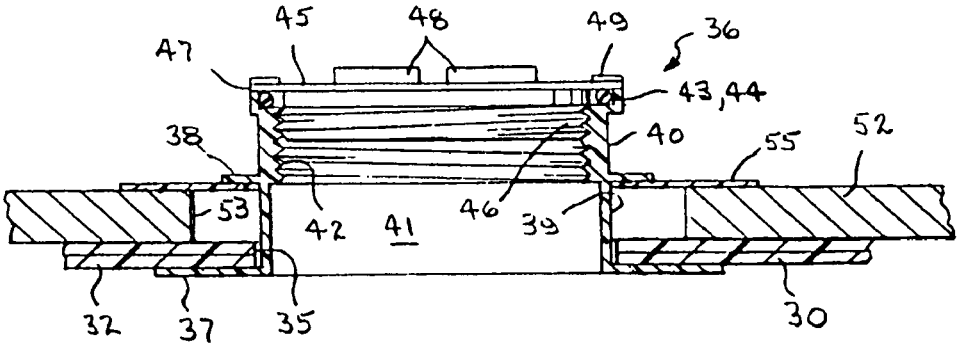
FIG. 6 is a cross sectional view of the bung and retainer flange mounted on the intermediate liner and supporting the top of the bag.

Referring additionally to FIGS. 5 and 6, the inner bag 30 is provided with an opening 35 in its top wall 32 in which a bung 36 is mounted for permitting flow of liquid into and out of the bag. The bung 36 has a flat circular bottom flange 37 which is heat sealed around the opening 35 in the top wall 32 of the bag, a second circular flange 38 of smaller diameter spaced a short distance above the bottom flange, a polygonal portion extending between the two flanges with four opposed flat surfaces 39, and a cylindrical neck portion 40 extending upwardly from the flange 38. The interior of the bung 36 has a central bore 41 in fluid communication with the interior of the bag 30 and is provided with interior threads 42 and an annular O-ring shoulder 43 at its top end which receives an O-ring 44.

A plug 45 having external threads 46 and a circular flange 47 extending radially outward therefrom is threadedly engaged in the interior threads 42 of the bung 36 such that the flange compresses the O-ring 44 and forms a fluid tight seal at the top end of the inner bag 30. The plug 45 is provided with a raised tool-receiving top surface 48 having flats, slots, and/or circumferentially spaced protrusions 49 for receiving a tool to install and remove the plug.

In a preferred embodiment, the inner bag 30 is constructed with a heat sealed bottom portal, comprising a hollow internally threaded bung, or valve fitment 50 heat sealed to the bag layers, for receiving a discharge valve. Initially, the layers of the inner bag 30 surrounded by the interior of the lower bung or valve fitment 50 are not open or penetrated. An externally threaded plug 51 is threadedly engaged in the interior threads of the bung or valve fitment 50. The plug 51 may be provided with a raised tool-receiving top surface having flats, slots, and/or circumferentially spaced protrusions for receiving a tool to install and remove the plug. A dispensing valve is subsequently attached, prior to the controlled dispensing of fluid from the inner bag 30.

To dispense the contents of the inner bag 30, a discharge valve is inserted into the bung or valve fitment 50 by seating it into the threaded area of the fitment. While being seated, a sharp knife-like probe or pusher/cutter on the valve pierces and cuts away a portion the layers of the inner bag 30. Once the layers of the inner bag are pierced and the valve is inserted, dispensing may take place through the valve. Valve fitments and valves of this type are commercially available from several companies, for example Hedwin Corporation of Baltimore, Md. These types of fitments and valves are known in the art and therefore are not shown or described in detail.

The top panel 52 is constructed of a rectangular sheet of plywood having a hole 53 at the center and narrow wooden framing boards 52A secured to its underside surface along the four opposed sides. The top panel 52 is received on the top ends of the stiffener panels 20 with the framing boards 52A disposed outward of the top ends of the stiffener panels.

A retainer flange 54 is provided for releasably retaining the bung 36 on the top panel 52 to maintain the bung in a proper position and prevent the top of the inner bag 30 from sagging during the filling operation. The retainer flange 54 is a thin flat generally rectangular frame-like member formed of relatively stiff plastic material having four opposed sides 55 surrounding a central rectangular opening 56. One of the sides 55 has a narrow gap 57 extending from the opening 56 to the exterior of the retainer flange 54. The retainer flange 54 is installed on the bung 36 by spreading or twisting two opposed sides adjacent to the gap apart a sufficient distance to fit over the smaller second flange 38 of the bung 36 and then releasing them such that the sides 55 of the retainer flange are disposed closely adjacent to the flats 39 of the bung, and the outer periphery of the smaller second flange of the bung overlaps the four sides of the retainer flange.

When the retainer flange 54 is installed, its four sides 55 overlap the hole 53 in the top panel 52 and the upper end of the bung 36 is supported on the four sides of the retainer flange. Thus, the bung 36 is captured and temporally supported on the top panel 52 and maintained within the hole 53 during the filling operation. After the filling operation, the sealing plug 45 is installed in the bung 36 and the retainer flange 54 is removed to allow the inner bag 30 to slightly collapse such that the bung is disposed beneath the top panel 52 and, thereafter, the opening 53 is covered by a cover member 58 to prevent access and provide a tamper resistant assembly. The cover member 58 may be a wooden board which is secured over the hole 53 in the top panel 52 by strapping bands in final assembly (as described below), or may be any other suitable type of cover member.

The pallet 60 has a deck 61 constructed of a rectangular sheet of plywood having narrow wooden framing boards 61A secured to its top surface along the four opposed sides. The inner liner/bag 11 and the stiffener panels 20 are supported on the top surface of the deck 61 with the bottom ends of the stiffener panels within the pockets 17 disposed inward of the framing boards 61A. Four wooden skids 62 are secured to the underside of the deck 61 in parallel equally spaced relation, and four horizontally disposed wooden bottom boards 63 are secured to the bottom of the wooden skids and extend transversely relative thereto. The pallet configuration is capable of supporting not only the weight of one container and its contents, but also is capable of supporting the weight of several stacked containers and provides openings on all four sides capable of receiving the forks of a fork lift. Thus, the pallet construction provides 4-way multi-directional fork lift access which is advantageous in that it allows better access for lifting and handling of the container and significantly reduces the likelihood of damage, spillage or leakage due to accidentally dropping a filled container.

In final assembly, conventional elongate strapping bands 70 are passed under the underside of the deck 61 of the pallet 60, the skids 62, and over the top panel 52 and cover member 58 and are secured to tightly secure the assembly and pallet together and retain the stiffener panels 20 in the proper position.

The stiffener panels 20 prevent bulging of the side walls of the inner bag 30 and provide vertical support, but their lateral sides are spaced apart and not joined together so as to form non-structural "floating corners" defined by the corners of the outer liner/bag 11 to maximize spatial volume, minimize shock, vibration and abrasive forces on the inner bag, yet maintain impact and compression strength to meet international certification standards.

As stated above, the stiffener panels 20, the top panel 52 and the pallet deck 61 are preferably constructed of plywood because it eliminates the use of hardwood materials and eliminates the heat treatment process needed for international export requirements and reduces the cost of construction, however, it should be understood that medium density fiberboard (MDF), and other materials capable of being nailed or stapled may be used, depending upon the particular application.

Figure 7:
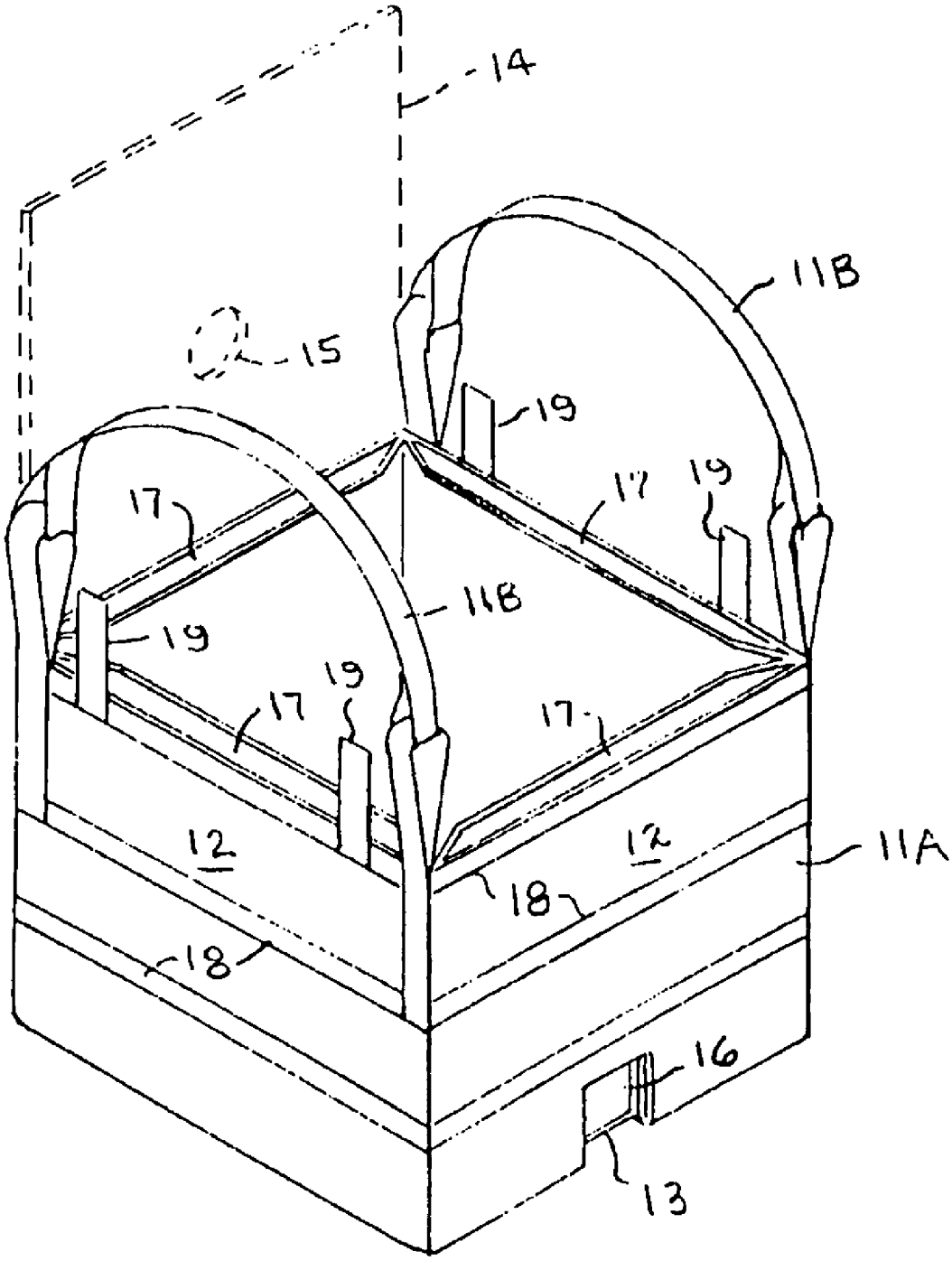
FIG. 7 is a perspective view of an alternate embodiment of the outer liner/bag having lifting straps for lifting the assembly.

FIG. 7 shows a modification of the outer liner/bag 11A which is essentially the same as the liner/bag 11 described above, but has looped lifting straps 11B secured at the upper end of two opposed sides for lifting the assembly. The components that are the same as described above are assigned the same references numerals, but will not be described again here to avoid repetition.

ASSEMBLY

The container 10 is assembled by placing the outer liner/bag 11 on the deck 61 of the pallet 60, installing the stiffener panels 20 into the pockets 17, and then installing the inner bag 30 into the outer liner/bag. The bung 36 of the inner bag 30 is raised upwardly and placed through the hole 53 in the top panel 52 and the retainer flange 54 is installed around the bung, and the top panel is placed on the top ends of the stiffener panels 20 such that the bung and upper end of the inner bag is supported by the top panel. Alternatively, the top panel 52 may first placed on the top ends of the stiffener panels 20, and then the bung 36 pulled upwardly through the hole 53 in the top panel 52 and retained by installing the retainer flange 54. Thus, the bung 36 is captured and temporally supported on the top panel 52 and maintained within the hole 53 during the filling operation.

If the outer liner/bag 11 is provided with the flexible cover flap 14, the cover flap is laid over the top wall of the inner bag 30 and the bung 36 is placed through the hole 15 in the cover flap and the rest of the flap is tucked or placed around the inner bag, prior to the bung raised or pulled upwardly through the hole 53 in the top panel 52 and installing the retainer flange 54.

After the filling operation, the sealing plug 45 is installed in the bung 36 at the top of the inner bag 30, and the retainer flange 54 is removed to allow the inner bag to slightly collapse such that the bung is disposed beneath the top panel 52 and, thereafter, the hole 53 in the top panel is covered by the cover member 58.

The tape tabs 34 and 19 of the inner bag 30 and outer liner/bag 11 may be attached to the top panel 52 and/or stiffener panels 20 to maintain the bag in an erected uncollapsed configuration during shipping and storage.

In final assembly, conventional elongate strapping bands 70 are passed under the underside of the deck 61 of the pallet 60, the skids 62, and over the top panel 52 and cover member 58 and are secured to tightly secure the assembly and pallet together and retain the stiffener panels 20 in the proper position.

The stiffener panels 20 prevent bulging of the side walls 31 of the inner bag 30 and provide vertical support, but their lateral sides are spaced apart and not joined together so as to form non-structural "floating corners" defined by the corners of the outer liner/bag to maximize spatial volume, minimize shock, vibration and abrasive forces on the inner bag, yet maintain impact and compression strength to meet international certification standards.

After assembly, the container assembly 10 is substantially tamper resistant. The inner bag 30 is entirely contained inside the assembly with the bung 36 at its top end inaccessible to prevent unauthorized opening, thus no product can be added to change or contaminate the stored product inside the sealed container.

The amount of liquid load held by the present container is significant. For example, in the case of a 330 gallon water load, the load weight is about 2,750 pounds. It is a significant achievement to be able to load 330 gallons (equal to six 55 gallon drums) into a container having a rectangular cubic shape. Such a container holds the volume of six drums in the space of four drums.

Furthermore, the present container has a significant advantage over other containers, such as those having a corrugated shell. The design of the outer shell of the present container provides structural strength to not only contain a full load of liquid, but also such that fully loaded, the container can be stacked three high for storage. Thus in the space of four drums stacked three high, for a total of twelve drums, the present container stacked three high, holds the volume of eighteen barrels or drums.

While the present invention has been disclosed in various preferred forms, the specific embodiments thereof as disclosed and illustrated herein are considered as illustrative only of the principles of the invention and are not to be considered in a limiting sense in interpreting the claims. The claims are intended to include all novel and non-obvious combinations and sub-combinations of the various elements, features, functions, and/or properties disclosed herein. Variations in size, materials, shape, form, function and manner of operation, assembly and use, are deemed readily apparent and obvious to one skilled in the art from this disclosure, and all equivalent relationships to those illustrated in the drawings and described in the specification are intended to be encompassed in the following claims defining the present invention.

The invention claimed is:

1. A container and supporting pallet for bulk handling of fluid which minimizes shock and abrasion on a fluid transporting bag within the container wherein the container elements are shaped to maximize the quantity of fluid containable therein and the container elements are structured to withstand the pressure exerted by such fluid, comprising:

a wooden pallet structure having a flat rectangular deck with narrow wooden framing members secured on a top surface along four opposed sides, a plurality of elongate rectangular wooden skids having a top edge secured to the underside of said deck in parallel equally spaced relation, and a plurality of horizontally disposed wooden bottom boards secured to a bottom edge of said skids and extending transversely relative thereto to provide openings on four sides of said pallet structure for receiving forks of a fork lift;

a generally rectangular flexible outer liner/bag supported on said deck formed of double wall water impervious internal woven plastic material having four side walls, an open top end, and a bottom wall, the double walls of said side walls secured together at the corners to form open top end pockets;

four generally rectangular rigid wooden stiffener panels, each having a bottom end, a top end and longitudinal lateral sides, and each removably received in a respective said pocket of said outer liner/bag and disposed in a generally vertical orientation, said stiffener panels having a width less than the width of said pockets such that their said lateral sides are spaced a distance apart and are not joined together so as to form non-structural floating corners defined only by the corners of said outer liner;

a flexible generally cubical multiple ply inner bag formed of liquid impervious material disposed inside of said outer liner/bag, said inner bag having four side walls, a top wall, and a bottom wall defining an interior, an internally threaded bung having a bottom flange sealed around an opening in said inner bag top wall, a second flange of smaller diameter spaced a short distance above said bottom flange, at least two laterally opposed flat surfaces extending between said bottom flange and said second flange, a neck portion extending upwardly from said second flange, a passageway in communication with said inner bag interior for permitting fluid passage into or out of said bag interior through said inner bag top wall, seal means at an upper end, and a removable closure member threadedly and sealingly engaged in said passageway;

an internally threaded valve fitment on one side wall of said inner bag near a bottom end for receiving a discharge valve, said valve fitment sealed to said inner bag such that the plies of said inner bag are not penetrated, and a removable closure member threadedly engaged in said valve fitment, said closure member being removed and said plies of said inner bag being penetrated upon subsequent attachment of a dispensing valve having a cutting element for controlled dispensing of fluid from said inner bag;

a flat generally rectangular wooden top panel having a central hole therethrough and narrow wooden framing members secured to an underside surface along four opposed sides, said top panel supported on said stiffener panels top ends with said framing members disposed outward of said stiffener panels top ends;

a cover member for covering said central hole in said top panel; and elongate strapping bands tightly secured beneath the underside of said pallet deck, said skids, and over said top panel and said cover member to retain said stiffener panels in position and secure said pallet, said inner liner/bag, said stiffener panels, and said top panel together as a tamper-resistant stackable unit with said inner bag and its said bung and valve fitment disposed entirely within said inner bag or liner.

2. The container according to claim 1, wherein said outer liner/bag is formed of flexible double wall internal woven coated polyethylene or polypropylene.

3. The container according to claim 1, wherein said top ends of said pockets are hemmed to facilitate insertion of said stiffener panels, and the outer periphery of said outer liner/bag is circumscribed by vertically spaced strips of reinforcement webbing.

4. The container according to claim 1, further comprising:

a generally rectangular flexible cover flap formed of water impervious internal woven plastic material and having a hole extending therethrough, said cover flap secured at one end to a top end of one of said outer liner/bag side walls and sized to cover said top end of said inner bag with said top bung of said inner bag received through said hole.

5. The container according to claim 4, wherein said flexible cover flap is formed of flexible internal woven polyethylene or polypropylene.

6. The container according to claim 1, further comprising:

a plurality of elongate tabs extending from an upper end of said inner bag of sufficient length to extend over said top ends of said stiffener panels for attachment to either of said top panel or said stiffener panels to maintain said inner bag in a generally erect uncollapsed configuration during shipping and storage.

7. The container according to claim 1, further comprising:

a plurality of elongate tabs extending from an upper end of at least two of said side walls of said outer liner/bag of sufficient length to extend over said top ends of said stiffener panels for attachment to said top panel to maintain said side walls of said outer liner/bag in a generally erect uncollapsed configuration during shipping and storage.

8. The container according to claim 1, wherein at least one of said side walls of said outer liner/bag and at least one of said stiffener panels is provided with an opening near a bottom end generally aligned to allow a discharge valve to be secured to said valve fitment of said inner bag.

9. The container according to claim 1, wherein each of said stiffener panels is constructed of a rectangular sheet of plywood with a pair of wooden reinforcing members secured vertically to said plywood sheet along laterally opposed sides, a second pair of wooden reinforcing members secured horizontally in vertically spaced relation between the vertical reinforcing members, and a third vertical wooden reinforcing member secured centrally between the horizontally spaced and laterally spaced reinforcing members, the laterally spaced vertical reinforcing members terminate a short distance inward from said top and bottom ends of said stiffener panel.

10. The container according to claim 1, further comprising:

looped lifting straps formed of webbing secured on two opposed sides of said outer liner/bag.

11. The container according to claim 1, further comprising:

a retainer flange for releasably engaging and retaining said inner bag bung in an accessible position with said neck portion thereof extending through said hole on said top panel and said removable closure member removed for filling said inner bag in a filling operation prior to covering said top panel central hole with said cover member and securing said elongate strapping bands, said removable closure member reinstalled and said retainer flange removed after the filling operation to allow said inner bag to slightly collapse such that said bung is disposed beneath said top panel and, thereafter, said hole in said top panel is covered by said cover member and said strapping bands are secured as recited.

12. A bag-in-bag container for bulk handling of fluent materials, comprising:

a generally rectangular flexible outer liner/bag formed of double wall water impervious internal woven plastic material having four side walls, an open top end, and a bottom wall, the double walls of said side walls secured together at the corners to form open top end pockets;

four generally rectangular rigid wooden stiffener panels, each having a bottom end, a top end and longitudinal lateral sides, and each removably received in a respective said pocket of said outer liner/bag and disposed in a generally vertical orientation, said stiffener panels having a width less than the width of said pockets such that their said lateral sides are spaced a distance apart and are not joined together so as to form non-structural floating corners defined only by the corners of said outer liner;

a flexible generally cubical multiple ply inner bag formed of liquid impervious material disposed inside of said outer liner/bag, said inner bag having four side walls, a top wall, and a bottom wall defining an interior, an internally threaded bung having a bottom flange sealed around an opening in said inner bag top wall, a neck portion disposed above said flange, a passageway in communication with said inner bag interior for permitting fluid passage into or out of said bag interior through said inner bag top wall, seal means at an upper end, and a removable closure member threadedly and sealingly engaged in said passageway; and an internally threaded valve fitment on one side wall of said inner bag near a bottom end for receiving a discharge valve, said valve fitment sealed to said inner bag such that the plies of said inner bag are not penetrated, and a removable closure member threadedly engaged in said valve fitment, said closure member being removed and said plies of said inner bag being penetrated upon subsequent attachment of a dispensing valve having a cutting element for controlled dispensing of fluid from said inner bag.

13. The bag-in-bag container according to claim 12, wherein said outer liner/bag is formed of flexible double wall internal woven coated polyethylene or polypropylene.

14. The bag-in-bag container according to claim 12, wherein said top ends of said pockets are hemmed to facilitate insertion of said stiffener panels, and the outer periphery of said outer liner/bag is circumscribed by vertically spaced strips of reinforcement webbing.

15. The bag-in-bag container according to claim 12, further comprising:

looped lifting straps formed of webbing secured on two opposed sides of said outer liner/bag.

16. A method for containerizing and palletizing fluent materials for bulk handling, shipping and storage, comprising the steps of:

providing a wooden pallet having a flat rectangular deck with narrow wooden framing members secured on a top surface along four opposed sides, a plurality of elongate rectangular wooden skids having a top edge secured to the underside of said deck in parallel equally spaced relation, and a plurality of horizontally disposed wooden bottom boards secured to a bottom edge of said skids and extending transversely relative thereto to provide openings on four sides of said pallet structure for receiving forks of a fork lift;

providing a generally rectangular flexible outer liner/bag formed of double wall water impervious internal woven plastic material having four side walls, an open top end, and a bottom wall, the double walls of said side walls secured together at the corners to form open top end pockets;

supporting said flexible outer liner/bag on said pallet deck;

providing four generally rectangular rigid wooden stiffener panels, each having a bottom end, a top end, longitudinal lateral sides, and a width less than the width of said pockets;

installing said stiffener panels in respective said pockets such that their said lateral sides are spaced a distance apart and are not joined together so as to form non-structural floating corners defined only by the corners of said outer liner;

providing a flexible generally cubical multiple ply inner bag formed of liquid impervious material having four side walls, a top wall, and a bottom wall defining an interior, an internally threaded bung having a bottom flange sealed around an opening in said inner bag top wall, a neck portion disposed above said flange, a passageway in communication with said inner bag interior for permitting fluid passage into or out of said bag interior through said inner bag top wall, seal means at an upper end, a removable closure member threadedly and sealingly engaged in said passageway, an internally threaded valve fitment on one side wall of said inner bag near a bottom end for receiving a discharge valve, said valve fitment sealed to said inner bag such that the plies of said inner bag are not penetrated, and a removable closure member threadedly engaged in said valve fitment;

installing said inner bag in the interior of said outer liner/bag;

providing a flat generally rectangular wooden top panel having a central hole therethrough and narrow wooden framing members secured to an underside surface along four opposed sides;

supporting said top panel on said stiffener panels top ends with said framing members of said top panel disposed outward of said stiffener panels top ends;

placing said neck portion of said bung of said inner bag through said hole on said top panel with an upper portion thereof extending upwardly therefrom;

providing a retainer flange configured to releasably engage said neck portion of said bung of said inner bag;

engaging said retainer flange on said bung neck portion to retain said upper portion thereof extending through said hole on said top panel, and removing said removable closure member;

filling said inner bag with a fluent material;

replacing said closure member in said bung;

disengaging said retainer flange from said bung neck portion, and allowing said inner bag to slightly collapse such that said bung is disposed beneath said top panel;

placing a cover member over said hole in said top panel; and securing elongate strapping bands tightly beneath the underside of said pallet deck, said skids, and over said top panel and said cover member to retain said stiffener panels in position and secure said pallet, said inner liner/bag, said stiffener panels, and said top panel together as a tamper-resistant stackable unit with said inner bag and its said bung and valve fitment disposed entirely within said inner bag or liner.

* * * * *